United States Patent [19]

Kindig et al.

[11] 4,229,209

[45] Oct. 21, 1980

[54] PROCESS FOR BENEFICIATING GOLD

[75] Inventors: James K. Kindig, Arvada; Ronald L. Turner, Golden, both of Colo.

[73] Assignee: Hazen Research, Inc., Golden, Colo.

[21] Appl. No.: 873,148

[22] Filed: Jan. 27, 1978

Related U.S. Application Data

[63] Continuation-in-part of Ser. No. 658,259, Feb. 17, 1976, abandoned.

[51] Int. Cl.[2] ..... C22B 1/00; C22B 11/00

[52] U.S. Cl. ..... 75/1 R; 75/83; 209/212; 427/132; 427/252

[58] Field of Search ..... 75/1 R, 17, 21, 28, 75/62, 72, 77, 82, 83; 423/23, 25, 138; 209/212, 213, 214; 427/47, 252, 253, 254, 255, 132

[56] References Cited

U.S. PATENT DOCUMENTS

| | | | |
|---|---|---|---|
| 2,132,404 | 10/1938 | Dean et al. | 423/25 |
| 2,332,309 | 10/1943 | Drummond | 427/252 |
| 2,944,883 | 7/1960 | Queneau et al. | 75/82 |
| 3,490,899 | 1/1970 | Krivisky et al. | 423/25 |
| 3,669,644 | 6/1972 | Sato | 423/25 |
| 3,767,760 | 10/1973 | Hougen et al. | 75/121 |

FOREIGN PATENT DOCUMENTS

| | | | |
|---|---|---|---|
| 119156 | 8/1959 | U.S.S.R. | 209/212 |

*Primary Examiner*—L. Dewayne Rutledge
*Assistant Examiner*—Michael L. Lewis
*Attorney, Agent, or Firm*—Sheridan, Ross, Fields & McIntosh

[57] ABSTRACT

A process for beneficiating particulate gold from non-magnetic foreign material with which it is mixed which comprises contacting the mixture with an iron carbonyl in order to selectively enhance the magnetic susceptibility of the gold particles so that a magnetic separation between the gold and foreign material may be effected.

19 Claims, No Drawings

PROCESS FOR BENEFICIATING GOLD

CROSS REFERENCES TO RELATED APPLICATIONS

This application is a continuation-in-part application of our now abandoned application Ser. No. 658,259 filed in the U.S. Patent and Trademark Office on Feb. 17, 1976.

BACKGROUND OF THE INVENTION

As is well known, since the government has lifted the price on gold from $35.00 an ounce, the price of gold has multiplied. As a result, many gold mines which were forced out of operation by the $35.00 an ounce ceiling have now resumed operations, and gold exploration and mining has greatly increased.

Because most gold ores contain less than a few ounces of gold per ton of ore, large amounts of gangue must be processed in order to recover the gold. In addition to the low grade of gold ores, the gold is usually present as very fine particles. Thus, gravity processes for the separation of gold from gangue are inefficient. This is due to the high viscous drag forces acting on small particles in water relative to the force of gravity.

Typically, large amounts of water are needed for beneficiating gold ores, particularly placer gold ores. This is a significant problem in recovering gold from low grade ores particularly placers existing in arid areas such as deserts. There is, therefore, considerable time and expense involved in recovering gold from its ores.

The above conditions have created a need for improved and more efficient beneficiating procedures for the recovery of gold from low grade ores, i.e., gold associated with foreign materials with which the gold exists in small percentages. Also, a process which operates dry would be especially useful, because it would provide a method for recovering gold which is located in deserts.

Accordingly, it is a principal object of this invention to provide an economically feasible method for separating gold from foreign material by selectively enhancing the magnetic susceptibility of the gold particles so that they may be successfully separated from the foreign material by magnetic separation.

SUMMARY OF THE INVENTION

The magnetic susceptibility of gold associated with foreign materials is increased to the point where magnetic separation of gold particles from the foreign material is feasible. The magnetic susceptibility of the gold particles is increased by contacting a mixture of particulate gold and foreign materials, such as occurs with placer deposits, with an iron carbonyl like iron pentacarbonyl under conditions at which general decomposition of the iron carbonyl into metallic iron and carbon monoxide is not appreciable. The carbonyl-treated mixture is then passed through a magnetic separator for removal of the gold particles.

Placer gold ores usually do not require grinding to achieve liberation; however, if required, they may be ground. The liberated ore is then contacted with carbonyl vapors in a gas treating chamber, either alone or by means of a gas that is inert to the process, which is used to carry the iron carbonyl vapors. Physical separation between gold and foreign material follows in a magnetic separator.

DESCRIPTION OF THE PREFERRED EMBODIMENTS

The invention is particularly useful for recovering gold from placer type gold deposits wherein gold particles which are either free or have an exposed surface exist in small percentages with large amounts of sand and other particulate material including dolomite, albite, muscovite, gypsum, and calcite. In the case of placer gold, grinding can ordinarily be dispensed with. The invention is applicable to recovering gold from quartz, granite, other type rocks, and other material to which it is attached; however, in the case of these materials it is ordinarily first necessary to grind the material to a sufficiently fine particle size to liberate particulate gold. This process also includes the recovery of more than one metal value at a time from an ore or mixture. The term "mixture" as used herein includes ore.

It is not known why the process of the invention enhances the magnetic susceptibility of the gold particles. It is well known that neither gold nor iron carbonyl are magnetic. It is probable that the gold is coated with a thin shell of metallic iron, which, of course, is magnetic. What is not known is why there should be a selective deposition of a film of magnetic material on the gold while under essentially the same conditions there is not decomposition of iron carbonyl producing a magnetic film on all the ore particles. Of course, a rapid and complete decomposition of iron carbonyl would result in coating particles of both gold and the foreign material with iron so that an effective magnetic separation would be obviated. Other metal carbonyls may be used such as those of the Group VIII metals nickel and cobalt.

Iron carbonyl decomposes under the proper temperature conditions in accordance with the following reaction:

$$Fe(CO)_5 \rightleftharpoons Fe + 5CO$$

The process is applied by contacting the mixture of gold and foreign material with iron carbonyl under conditions wherein the iron carbonyl decomposes to form a magnetic skin on the gold particles but not on the foreign material. These conditions are determined by the temperature, the type of carbonyl used, pressure, gas composition, etc. Ordinarily, the reaction occurs at a temperature just below the substantial decomposition temperature of the carbonyl in the presence of an ore. Various types of available equipment can be used for contacting the gold and foreign material with iron carbonyl vapors, such as, a rotating kiln used as a reaction vessel with the material being contacted directly with iron carbonyl vapors or the vapors carried into contact with the tumbling contents of the kiln by a gas such as nitrogen which is inert to the reaction process. It has been found that the material which enhances the magnetic susceptibility of the gold particles exercises a preferential selectivity for the gold particles over the particles of the foreign material.

The process must be carried out at a temperature below the temperature of major decomposition of the carbonyl under the reaction conditions so that there is no opportunity for decomposition of the carbonyl on a nonselective basis or, perhaps, for its reaction with some material to produce the magnetic material with which the gold particles are coated. Obviously, if the temperature is allowed to rise above the decomposition temperature of the carbonyl for sufficient time, complete decomposition of the carbonyl will occur with the result that the particles of the foreign material as well as the gold will be coated with metallic iron to give both types of particles an enhanced magnetic susceptibility, thus preventing their effective separation magnetically.

The amount of carbonyl used and the time of treatment can be varied to effect substantially complete magnetization of the gold present. The time, temperature and injection rate of the treatment is a balance between the reaction rate and the economics of the magnetic separation process. Carbonyl will be added in an amount of from about 0.1 to about 128 kilograms per metric ton of feed with from about 0.25 to about 8 kilograms per metric ton of feed being preferred and from about 0.5 to about 4.0 kilograms per metric ton of feed being more preferred. Additionally, it is preferred to inject the carbonyl into the reactor during the first half of the roast period and it is more preferred if it is injected during the first quarter of the roast and most preferred if injected during the first tenth of the roast period.

Generally, a reaction time not in excess of about two hours is adequate, with a reaction time not in excess of one hour being preferred and a reaction time not in excess of a half hour being most preferred. The temperature at which the reaction is formed at atmospheric pressure can vary between about 100°-250° C., a preferred temperature range is from about 100° to about 150° C. and a more preferred temperature range is from about 110° to about 130° C. Generally, the higher the temperature, the more complete the gold recovery with lower gold concentration in both the tails and the magnetic concentrate and the larger the amount of magnetic concentrate. Therefore, for any feed material, the economics of the situation will have to be considered and conditions set to produce the most favorable balance between the grade and recovery.

If desired, prior to treating the gold and foreign material with iron carbonyl, the mixture of gold and foreign material can be magnetically cleaned to remove any magnetic impurities. Thereafter, the non-magnetic fraction of the mixture is treated with the iron carbonyl. After the feed mixture containing the gold has been treated with a metal carbonyl, it is then subjected to a magnetic separation process to effect the separation of gold. Any of many commercially available magnetic separators can be used to remove the gold from the gangue. For example, low or medium intensity separations can be made with a permanent magnetic drum separator (field strengths up to about 2,500 gauss), electromagnetic drum separators (field strengths up to about 7,000 gauss), induced roll separators (field strengths of about 11,000 gauss) or other configurations known to those skilled in the art. Additionally, newer high-gradient magnetic separators are especially good for separating fines, although they are generally operated wet. A dry magnetic separation process for gold is generally preferred. This avoids the expense of dewatering and also allows for the recovery of gold from deserts.

The invention is illustrated by the examples presented below in which samples of placer gold and associated foreign material were treated by the process of the invention. The examples are illustrative of the invention but not limiting thereof.

EXAMPLE 1

In this example, a sample of placer gold concentrate was diluted with gangue of essentially silicon dioxide and aluminum dioxide. The resultant sample contained 4050 grams gold per metric ton of placer ore. For the purpose of a blank, a comparative magnetic separation was made on an untreated portion of the sample. Another portion of the sample was treated with the process of the invention at 135° C. and a third portion of the sample was treated by the process of the invention at temperatures up to 145° C. Both of the treated samples were subjected to magnetic separation as in the first test, and the magnetic and nonmagnetic fractions of each test were analyzed as to gold content with the gold distribution for the magnetic and nonmagnetic fractions of each test computed. By "Gold Distribution" is meant the percentage of gold in the entire beginning sample which is partitioned to the specified final fraction. The following table sets forth the results obtained.

TABLE 1

| Treatment of Sample | Fractions | Weight % of Sample | Gold Assay oz/ton | Gold Distribution % |
|---|---|---|---|---|
| No Treatment | Magnetic | 11.54 | 21.26 | 1.92 |
| | Non-Magnetic | 88.46 | 142.04 | 98.08 |
| Low Temperature 135° C. 30 min 32 kg/m.ton $Fe(CO)_5$ | Magnetic | 11.95 | 132.87 | 13.29 |
| | Non-Magnetic | 88.05 | 117.68 | 86.71 |
| High Temperature up to 145° C. in 23 min | Magnetic | 14.18 | 200.83 | 26.79 |
| Total 23 kg/m.ton $Fe(CO)_5$ | Non-Magnetic | 85.82 | 90.70 | 73.21 |

EXAMPLE 2

To provide a test sample for this example, 4.7 grams of the non-magnetic fraction of a placer gold concentrate was blended with 195 grams of sand. Analysis of this material showed a gold content of 84 grams per metric ton. A one-fourth split of the above material (52 grams) was placed in a rotating glass reactor and heated to 150° C. under nitrogen. At this temperature, the mixture was exposed to vapors of iron carbonyl for one-half hour at an amount equal to about 32 kilograms of carbonyl per metric ton of material. Cool down was under nitrogen. After treatment, magnetic separation was effected by using a Dings crossbelt separator with a 4.5 amp setting. Two recleanings of the magnetic material were made.

The results of the above tests are set forth in the following table:

TABLE 2

| | Yield (Wt. %) | Gold (Oz/Ton) | Distribution of Gold % |
|---|---|---|---|
| Concentrate (Magnetic) | 0.96 | 225. | 88.3 |
| Gangue (Non-Magnetic) | 99.04 | 0.29 | 11.7 |

EXAMPLE 3

The sample of Clear Creek placer gold from Colorado was diluted with silica to yield a gold content of 1.0 kilogram per metric ton. This placer gold ore was treated with 1 kilogram of iron pentacarbonyl per metric ton feed at a temperature of 122° C. for 15 minutes. The iron carbonyl was injected in 1.5 minutes coincident with the start of the 15 minute roast and the reaction chamber was purged with nitrogen during heating and cool down. The reactor product was magnetically separated yielding a magnetic concentrate of 57.4 kilograms per metric ton of gold (1676 ounce per ton) and 1.6% of the feed. The non-magnetic tails contained 66.9 grams per metric ton gold (1.95 ounce per ton). The overall gold recovery was 93.3%.

EXAMPLE 4

To several non-magnetic fractions of 28- ×150-mesh Vulture placer from Arizona spiked with non-magnetic 28- ×150-mesh Clear Creek gold concentrate to a total of 891 grams per metric ton (26 ounce per ton) were added various common minerals. Several samples were made from this mixture by adding an excess of 10% of each of the gangue minerals so that the gold content of the composited placer ore was approximately 823 grams per metric ton (24 ounce per ton). Each of the mixtures was then treated with 1 kilogram of iron pentacarbonyl per metric ton of feed for 15 minutes at 122° C. in a small glass rotary reactor. The treated ore was then separated using an induced magnetic roll (IMR) separator and the products assayed for gold. The results are given below in Table 3.

TABLE 3

| Added Mineral | Magnetic Fraction | Yield Wt. % | Gold Assay oz/ton | Gold Recovery % of Total |
|---|---|---|---|---|
| Muscovite | Magnetic | 28.6 | 82.6 | 89.3 |
| | Nonmagnetic | 71.4 | 3.98 | |
| | Calc head | 100.0 | 26.5 | |
| Gypsum | Magnetic | 19.0 | 126.0 | 89.9 |
| | Nonmagnetic | 81.0 | 3.34 | |
| | Calc head | 100.0 | 26.6 | |
| Hematite | Magnetic | 51.3 | 33.3 | 76.5 |
| | Nonmagnetic | 48.7 | 10.8 | |
| | Calc head | 100.0 | 22.3 | |
| Albite | Magnetic | 19.8 | 125.0 | 87.4 |
| | Nonmagnetic | 80.2 | 4.46 | |
| | Calc head | 100.0 | 28.3 | |
| Dolomite | Magnetic | 19.0 | 91.2 | 85.9 |
| | Nonmagnetic | 81.0 | 3.52 | |
| | Calc head | 100.0 | 20.2 | |
| Calcite | Magnetic | 19.0 | 93.9 | 86.7 |
| | Nonmagnetic | 81.0 | 3.37 | |
| | Calc head | 100.0 | 20.6 | |
| Silica[1] | Magnetic | 1.6 | 1676.0 | 93.3 |
| | Nonmagnetic | 98.4 | 1.95 | |
| | Calc head | 100.0 | 28.7 | |
| Vulture[2] | Magnetic | 20.4 | 99.1 | ≈78.0 |
| | Nonmagnetic | 79.6 | — | |
| | Calc head | 100.0 | 28.7 | |
| Vulture[2] | Magnetic | 20.2 | 106.0 | ≈82.0 |
| | Nonmagnetic | 79.8 | — | |
| | Calc head | 100.0 | 26.0 | |

[1]Clear Creek gold concentrate added to silica sand, no Vulture placer.
[2]Assay data not available for tails.

EXAMPLE 5

A synthetic placer containing 891 grams of gold per metric ton (26 ounce per ton) was diluted with magnetically scalped Vulture placer to 27.1 grams of gold per metric ton of feed (0.79 ounce per ton). The gold particles contained in this feed material were 28- ×150-mesh. A second sample of a placer containing a low gold content was prepared by adding 49 flakes of 65- ×100-mesh gold (hand picked from Clear Creek concentrate) to one kilogram of magnetically scalped Vulture placer. This resulted in a placer ore containing 3.4 grams of gold per metric ton of feed (0.098 ounce per ton). One kilogram samples of each of these mixtures was then separately treated at 122° C. for 15 minutes with an iron pentacarbonyl dosage of one kilogram per metric ton of feed. The carbonyl was injected into the reactor by a syringe pump calibrated to deliver the required amount of iron carbonyl in the first 1.5 minutes of the roast. The test results are presented in Table 4.

TABLE 4

| Fraction | Yield, Wt % | Gold Assay, oz/ton | Gold Recovery % of Total |
|---|---|---|---|
| Magnetic | 11.6 | 5.82 | 85.7 |
| Nonmagnetic | 88.4 | 0.127 | |
| Calc head | 100.0 | 0.787 | |
| Magnetic | 14.1 | 0.49 | 69.9 |
| Nonmagnetic | 85.1 | 0.034 | |
| Calc head | 100.0 | 0.098 | |

EXAMPLE 6

Eight 90 gram samples of a simulated gold placer ore with a size range of 28- ×150-mesh were subjected to two different roast durations, i.e. 15 minutes and 60 minutes. For each of these times two injection rates were used, additionally the effect of varying roast time and injection rates were analyzed with respect to different size fractions. All of the samples were treated with 4 kilograms of iron carbonyl per metric ton at a temperature of 120°-122° C. For the "slow" injection rate, the iron carbonyl was injected during the entire run, while for the "fast" injection rate, all the iron carbonyl was injected in the first 11% of the roast time, i.e. 1.65 minutes for the 15 minute run and 6.6 minutes for the 60 minute run. The results are given below in Tables 5 and 6.

TABLE 5

| Roast Time | Injection Time | Product | Yield, % | Gold Assay, oz/ton | Gold Dist. % | Gold Distribution % Per % Yield |
|---|---|---|---|---|---|---|
| 15 min. | Fast | Magnetic concentrate | 12.2 | 242.90 | 99.1 | 8.13 |
| | | Nonmagnetic tails | 87.8 | 0.29 | 0.9 | 0.01 |
| | | Calculated feed | 100.0 | 29.89 | 100.0 | |
| 15 min | Slow | Magnetic concentrate | 11.6 | 217.93 | 97.9 | 8.44 |
| | | Nonmagnetic tails | 88.4 | 0.61 | 2.1 | 0.02 |
| | | Calculated feed | 100.0 | 25.82 | 100.0 | |
| 60 min | Fast | Magnetic concentrate | 15.6 | 184.32 | 98.2 | 6.30 |
| | | Nonmagnetic tails | 84.4 | 0.61 | 1.8 | 0.02 |
| | | Calculated feed | 100.0 | 29.27 | 100.0 | |

TABLE 5-continued

| Roast Time | Injection Time | Product | Yield, % | Gold Assay, oz/ton | Gold Dist. % | Gold Distribution % Per % Yield |
|---|---|---|---|---|---|---|
| 60 min. | Slow | Magnetic concentrate | 21.1 | 148.99 | 97.9 | 4.64 |
| | | Nonmagnetic tails | 78.9 | 0.86 | 2.1 | 0.03 |
| | | Calculated feed | 100.0 | 32.12 | 100.0 | |

TABLE 6

| Reaction Time, min | Injection Time | Size Fraction, Mesh | Yield, % Magnetic | Yield, % Nonmagnetic | Gold Assay, oz/ton Magnetic | Gold Assay, oz/ton Nonmagnetic |
|---|---|---|---|---|---|---|
| 15 | Fast | 28 × 35 | 6.08 | 32.72 | 372.38 | 0.45 |
| | | 35 × 65 | | 38.02 | | 0.09 |
| | | 65 × 150 | 6.13 | 17.05 | 114.47 | 0.41 |
| 15 | Slow | 28 × 35 | 6.14 | 35.71 | 304.23 | 0.58 |
| | | 35 × 65 | | 36.28 | | 0.88 |
| | | 65 × 150 | 5.47 | 16.41 | 121.05 | 0.06 |
| 60 | Fast | 28 × 35 | 8.10 | 31.36 | 273.60 | 1.50 |
| | | 35 × 65 | | 37.92 | | <0.005 |
| | | 65 × 150 | 7.52 | 15.10 | 88.16 | 0.29 |
| 60 | Slow | 28 × 35 | 11.16 | 34.73 | 222.88 | 1.80 |
| | | 35 × 65 | | 32.02 | | <0.005 |
| | | 65 × 150 | 9.90 | 12.20 | 65.70 | 0.44 |

EXAMPLE 7

A synthetic gold placer ore was prepared from the nonmagnetic fraction of Vulture placer spiked to approximately 920 grams gold per metric ton feed with the nonmagnetic portion of Clear Creek gold concentrate. The size range of the feed was 28- ×150-mesh. Four different samples were treated with 4 kilograms iron pentacarbonyl per metric ton of feed for a period of 15 minutes at various temperatures. The results are given below in Table 7.

TABLE 7

| Treatment Temperature °C. | Fraction | Yield Wt. % | Gold Assay, oz/ton | Gold Distribution % |
|---|---|---|---|---|
| 110 | Magnetic | 9.42 | 245. | 86.2 |
| | Nonmagnetic | 90.58 | 4.09 | 13.8 |
| | Calc head | 100.0 | 26.8 | |
| 115 | Magnetic | 9.37 | 276. | 93.7 |
| | Nonmagnetic | 90.63 | 1.93 | 6.3 |
| | Calc head | 100.0 | 27.6 | |
| 125 | Magnetic | 25.42 | 93.0 | 99.2 |
| | Nonmagnetic | 74.58 | 0.26 | 0.8 |
| | Calc head | 100.0 | 23.8 | |
| 135 | Magnetic | 73.42 | 39.2 | 99.98 |
| | Nonmagnetic | 26.58 | <0.02 | <0.02 |
| | Calc head | 100.0 | 28.8 | |

EXAMPLE 8

A synthetic gold placer was prepared from a nonmagnetic fraction of a Vulture placer spiked to approximately 891 grams gold per metric ton of feed (26 ounce per ton) with a nonmagnetic portion of Clear Creek gold concentrate. The size range of the feed was 28- ×150-mesh. Each sample was roasted in a small reactor for 15 minutes at the specified temperatures of either 110°, 120° or 130° C. at a prescribed iron carbonyl dosage of 0.25, 1 or 4 kilograms of iron pentacarbonyl per metric ton of feed injected during the first 1.5 minutes of the roast.

A total of 14 tests were performed in random order with the magnetic separation of the reactor product being carried out on the size fractions: 28×65-mesh and 65×150-mesh. For each size fraction three passes were made over an induced magnetic separator at 75 rpm and 8 amp coil current. The results of these tests are summarized for the composited size fractions in Table 8.

TABLE 8

| Run Order | Roast Temperature °C. | Iron Carbonyl Dosage, kg/m.ton | Fraction | Yield, Wt % | Gold Assay, oz/ton | Gold Recovery % |
|---|---|---|---|---|---|---|
| 11 | 110 | 0.25 | Magnetic | 15.1 | 97.8 | 61.0 |
| | | | Nonmagnetic | 84.9 | 11.1 | |
| | | | Calc head | 100.0 | 24.2 | |
| 12 | 110 | 0.25 | Magnetic | 12.2 | 86.3 | 40.9 |
| | | | Nonmagnetic | 87.8 | 17.3 | |
| | | | Calc head | 100.0 | 25.7 | |
| 5 | 110 | 1.0 | Magnetic | 15.0 | 113 | 72.7 |
| | | | Nonmagnetic | 85.0 | 7.48 | |
| | | | Calc head | 100.0 | 23.3 | |
| 6 | 110 | 4.0 | Magnetic | 16.5 | 135 | 78.4 |
| | | | Nonmagnetic | 83.5 | 7.35 | |
| | | | Calc head | 100.0 | 28.4 | |
| 7 | 110 | 4.0 | Magnetic | 17.1 | 111 | 75.0 |
| | | | Nonmagnetic | 82.9 | 7.65 | |
| | | | Calc head | 100.0 | 25.3 | |
| 14 | 120 | 0.25 | Magnetic | 16.9 | 120 | 88.0 |
| | | | Nonmagnetic | 83.1 | 3.32 | |
| | | | Calc head | 100.0 | 23.0 | |
| 3 | 120 | 1.0 | Magnetic | 18.0 | 147 | 88.0 |
| | | | Nonmagnetic | 82.0 | 4.41 | |
| | | | Calc head | 100.0 | 30.0 | |
| 4 | 120 | 1.0 | Magnetic | 16.1 | 160 | 88.7 |
| | | | Nonmagnetic | 83.9 | 3.93 | |
| | | | Calc head | 100.0 | 29.1 | |
| 9 | 120 | 4.0 | Magnetic | 16.3 | 116 | 80.6 |
| | | | Nonmagnetic | 83.7 | 5.44 | |
| | | | Calc head | 100.0 | 23.4 | |
| 13 | 120 | 4.0 | Magnetic | 20.9 | 108 | 83.8 |

TABLE 8-continued

| Run Order | Roast Temperature °C. | Iron Carbonyl Dosage, kg/m.ton | Fraction | Yield, Wt % | Gold Assay, oz/ton | Gold Recovery % |
|---|---|---|---|---|---|---|
| | | | Nonmagnetic | 79.1 | 5.54 | |
| | | | Calc head | 100.0 | 27.0 | |
| 8 | 130 | 0.25 | Magnetic | 31.8 | 74.8 | 89.2 |
| | | | Nonmagnetic | 68.2 | 4.24 | |
| | | | Calc head | 100.0 | 26.6 | |
| 1 | 130 | 1.0 | Magnetic | 19.4 | 133 | 95.0 |
| | | | Nonmagnetic | 80.6 | 1.69 | |
| | | | Calc head | 100.0 | 27.2 | |
| 10 | 130 | 1.0 | Magnetic | 16.3 | 123 | 81.1 |
| | | | Nonmagnetic | 83.7 | 5.57 | |
| | | | Calc head | 100.0 | 24.7 | |
| 2 | 130 | 4.0 | Magnetic | 23.7 | 128 | 93.3 |
| | | | Nonmagnetic | 76.3 | 2.84 | |
| | | | Calc head | 100.0 | 32.5 | |

EXAMPLE 9

A placer ore containing 446 grams gold per metric ton of feed (13 ounces per ton) which had been treated with 4 kilograms of iron pentacarbonyl per metric ton of feed for one hour at a temperature of 125° to 130° C. in a large reactor was subjected to abrasive and weathering conditions prior to magnetic separation of the gold. The results are given below in Table 9.

TABLE 9

| Sample Treatment Before Magnetic Separation | Fraction | Yield % | Gold Assay, oz/Ton | Gold Recovery % |
|---|---|---|---|---|
| Aged One Month in Dry Air | Magnetic | 39.7 | 36.3 | 96.8 |
| | Nonmagnetic | 60.3 | 0.78 | |
| | Calc head | | 14.9 | |
| Aged Two Months in Dry Air | Magnetic | 35.9 | 35.3 | 95.8 |
| | Nonmagnetic | 64.1 | 0.87 | |
| | Calc head | | 13.2 | |
| Aged Two Months in Dry Air, Tumbled 24 Hours in Blender | Magnetic | 34.9 | 33.2 | 97.2 |
| | Nonmagnetic | 65.1 | 0.52 | |
| | Calc head | | 11.9 | |
| Aged Two Months in Dry Air, Exposed 48 Hours to 100% Humidity, Stored 24 Hours in Vial | Magnetic | 37.2 | 30.5 | 91.4 |
| | Nonmagnetic | 62.8 | 1.70 | |
| | Calc head | | 12.4 | |

EXAMPLE 10

Samples of a non-magnetic fraction of 28- ×65-mesh Vulture placer were spiked with non-magnetic 28- ×65-mesh Clear Creek gold concentrate to obtain 1.99 kilograms of gold per metric ton of synthetic placer (58 oz/ton). The synthetic placer was then wet-screened at 65-mesh to remove fines. Thereafter, each sample was treated with iron carbonyl at varying levels at 122° C. in a small glass rotary reactor for 15 minutes. In each case, the carbonyl was injected during the first 1.5 minute of the roast. Results are given below.

TABLE 10

| Iron Carbonyl Dosage kg/m.ton | Yield, Wt. % Magnetic | Yield, Wt. % Non-magnetic | Gold, oz/ton Magnetic | Gold, oz/ton Non-magnetic | Calc Head | Gold Recovery, % of Feed |
|---|---|---|---|---|---|---|
| 1 | 9.3 | 90.7 | 560 | 8.14 | 59.5 | 87.6 |
| 2 | 9.6 | 90.4 | 491 | 5.06 | 51.7 | 91.2 |
| 4 | 10.1 | 89.9 | 558 | 4.19 | 60.1 | 93.7 |
| 8 | 11.0 | 89.0 | 496 | 3.80 | 57.9 | 94.2 |
| 16 | 15.8 | 84.2 | 368 | 2.59 | 60.3 | 96.4 |

What is claimed is:

1. A process for beneficiating particulate gold from foreign material with which it is mixed which comprises contacting the mixture with an iron carbonyl under conditions which cause the iron carbonyl to decompose and then cause a coating at the surface of the gold particles to the substantial exclusion of the foreign material so as to alter the surface characteristics of the gold particles thereby causing a selective enhancement of the magnetic susceptibility of the gold particles to the substantial exclusion of the foreign material so that a magnetic separation between the gold and foreign material may be effected.

2. The process of claim 1 in which the treated mixture is subjected to a magnetic field to remove gold particles from the foreign material.

3. The process of claim 1 in which the iron carbonyl is iron pentacarbonyl.

4. The process of claim 3 in which the carbonyl is in gaseous form and is contacted with the mixture in an inert carrier gas.

5. The process of claim 1 wherein the foreign material is selected from the group consisting of granite, quartz, muscovite, alumina, gypsum, albite, dolomite, calcite, hematite and silica.

6. The process of claim 1 wherein the mixture is magnetically cleaned and the non-magnetic fraction of the mixture is then contacted with iron carbonyl.

7. The process of claim 1 wherein the mixture of gold and foreign material is contacted with iron carbonyl at a temperature between 100° C. and 250° C.

8. A process for beneficiating gold mixed with foreign material, which comprises the steps of:

(a) reducing the mixture to a particulate form;

(b) placing the particulate mixture in a gas treatment chamber;

(c) introducing iron carbonyl vapor into said chamber under conditions which preclude substantial non-selective decomposition of the iron carbonyl, and (d) maintaining the iron carbonyl vapor in contact with said mixture for a sufficient time for the iron carbonyl to selectively enhance the magnetic susceptibility of substantially all of the gold particles in the mixture.

9. The process of claim 8 wherein the temperature of the chamber is not in excess of about 250° C.

10. The process of claim 8 wherein the iron carbonyl vapor is contacted with said mixture at a temperature between 110° C. and 130° C.

11. The process of claim 8 wherein from about 0.25 to about 8 kilograms of iron carbonyl per metric ton of mixture are introduced into said chamber.

12. The process of claim 8 wherein the iron carbonyl vapor is maintained in contact with said mixture for less than one-half hour.

13. The process of claim 8 wherein the iron carbonyl gas is first contacted with an inert carrier gas and then introduced into said chamber.

14. A process for recovering gold from a mixture of gold with other material which comprises contacting the mixture with a carbonyl of a Group VIII metal under conditions which cause the Group VIII metal carbonyl to decompose and then cause a coating at the surface of the gold to the substantial exclusion of the other material so as to alter the surface characteristics of the gold thereby causing a selective enhancement of the magnetic susceptibility of the gold to the substantial exclusion of the other material so that a magnetic separation between the gold and said other material may be effected.

15. The process of claim 14 in which the Group VIII metal is a member selected from the group consisting of iron, nickel and cobalt.

16. The process of claim 15 in which the metal is iron.

17. A process for beneficiating gold mixed with foreign material, comprising:

(a) reducing the mixture to a particulate form;

(b) placing the particulate mixture in a gas treatment chamber;

(c) contacting an inert carrier gas with iron carbonyl vapor to incorporate the iron carbonyl vapor in the carrier gas;

(d) introducing the iron carbonyl vapor carried in the carrier gas into said chamber at a rate of from about 0.5 to about 4.0 kilograms of iron carbonyl per metric ton of particulate material and at a temperature from about 110° C. to about 130° C.

(e) maintaining the iron carbonyl vapor in contact with said mixture for less than one-half hour to selectively enhance the susceptibility of substantially all of the gold particles in the mixture;

(f) separating the gold particles from the mixture by magnetic separation.

18. The process of claim 17 wherein the iron carbonyl is iron pentacarbonyl.

19. The process of claim 8 wherein the iron carbonyl is iron pentacarbonyl.

* * * * *